US006662786B2

(12) United States Patent
Watanabe

(10) Patent No.: US 6,662,786 B2
(45) Date of Patent: Dec. 16, 2003

(54) VAPOR SEPARATOR FOR OUTBOARD MOTOR

(75) Inventor: Hitoshi Watanabe, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 66 days.

(21) Appl. No.: 10/072,665

(22) Filed: Feb. 7, 2002

(65) Prior Publication Data

US 2002/0124835 A1 Sep. 12, 2002

Related U.S. Application Data

(60) Provisional application No. 60/322,510, filed on Sep. 13, 2001.

(30) Foreign Application Priority Data

Feb. 7, 2001 (JP) ..... 2001-030661

(51) Int. Cl.[7] ..... F02M 37/04
(52) U.S. Cl. ..... 123/516
(58) Field of Search ..... 123/516

(56) References Cited

U.S. PATENT DOCUMENTS

| | | | | |
|---|---|---|---|---|
| 3,687,335 A | * | 8/1972 | Hunter | 220/85 VR |
| 4,515,134 A | * | 5/1985 | Warren, II | 123/557 |
| 5,375,578 A | | 12/1994 | Kato et al. | |
| 5,404,858 A | | 4/1995 | Kato | |
| 5,797,378 A | | 8/1998 | Kato | |
| 5,855,197 A | | 1/1999 | Kato | |
| 5,865,160 A | | 2/1999 | Kato | |
| 5,873,347 A | | 2/1999 | Kato et al. | |
| 5,915,363 A | | 6/1999 | Iwata et al. | |
| 5,957,112 A | | 9/1999 | Takahashi et al. | |
| 6,030,262 A | | 2/2000 | Okamoto et al. | |

FOREIGN PATENT DOCUMENTS

JP 10-218089 8/1998

OTHER PUBLICATIONS

Co–pending U.S. patent application No. 09/648,827, filed Aug. 25, 2000.

* cited by examiner

*Primary Examiner*—Thomas N. Moulis
(74) *Attorney, Agent, or Firm*—Knobbe, Martens, Olson & Bear LLP

(57) ABSTRACT

An engine for an outboard motor includes an engine body and at least one piston, together defining a combustion chamber. An air intake system is arranged to introduce air to the combustion chamber. The intake system includes an intake conduit extending along the engine body. A fuel injection system also is arranged to spray fuel for combustion in the combustion chamber. The fuel injection system includes a vapor separator that contains the fuel and removes vapor from the fuel. The vapor separator is disposed between the engine body and the intake conduit. The vapor separator has a drainage mechanism to drain the fuel and an atmosphere introduction mechanism to introduce atmosphere that replaces a volume of the drained fuel. The atmosphere introduction mechanism has an operating member that has an axis along which the operating member moves. The axis preferably does not intersect with the intake conduit.

18 Claims, 4 Drawing Sheets

VAPOR SEPARATOR FOR OUTBOARD MOTOR

PRIORITY INFORMATION

This application is based on and claims priority to Japanese Patent Application No. 2001-030661, filed Feb. 7, 2001, the entire contents of which is hereby expressly incorporated by reference. This application further claims the benefit of U.S. Provisional Application No. 60/322,510, filed Sep. 13, 2001.

BACKGROUND OF THE INVENTION

1. Field of the Invention

The present invention relates generally to a vapor separator for an outboard motor and, more particularly, to an improved vapor separator that has a fuel drainage mechanism.

2. Description of Related Art

Internal combustion engines for outboard motors may employ fuel injection systems to improve emission control and fuel economy. Fuel injection systems typically comprise a vapor separator that removes vapor before supplying the fuel to a fuel injector. The vapor separator can have a drainage mechanism to drain fuel accumulating therein for maintenance of the engine or for storage of the outboard motor. For example, U.S. Pat. Nos. 5,375,578 and No. 5,404,858 disclose such drain mechanisms.

Typically, the drain mechanisms include a drain plug threaded into a drain hole located at a lower portion of the vapor separator. In some arrangements, the vapor separator can have a vapor delivery conduit that is directly or indirectly connected to a plenum chamber of an air intake system of the engine to deliver vapor to the intake system for induction. This arrangement is beneficial not only for inhibiting vapor emissions to the atmosphere but also for expediting the drainage of the fuel.

Preferably, the vapor delivery conduit is formed as narrow as possible so that the vapor can be gradually delivered to the intake system such that the impact on the air/fuel ratio is minimized. The narrow conduit, however, decreases the rate of drainage.

SUMMARY OF THE INVENTION

A need therefore exists for an improved vapor separator for an outboard motor that permits a vapor separator to communicate with the atmosphere other than through a vapor delivery conduit.

One mechanism could be an atmosphere introduction mechanism that directly introduces atmosphere into the vapor separator. Such a mechanism could be manually operated by a user, operator, mechanic or repairperson. Such an arrangement creates further difficulties.

Typically, the air intake system for an outboard motor comprises one or more intake conduits extending generally horizontally along an engine body of the engine. The vapor separator can be disposed between the engine body and the intake conduit(s). In this arrangement, however, access to the operating member is inhibited because the vapor separator that has the operating member is positioned behind the intake conduit(s).

Another need therefore exists for an improved vapor separator for an outboard motor that can have an atmosphere introduction mechanism that is easily accessible or operable even if the vapor separator is positioned behind an intake conduit(s).

In accordance with one aspect of the present invention, an internal combustion engine for an outboard motor comprises an engine body. A moveable member is moveable relative to the engine body. The engine body and the moveable member together define at least one combustion chamber. An air intake system is arranged to introduce air to the combustion chamber. The intake system includes an intake conduit extending along at least part of the engine body. A fuel delivery system is arranged to deliver fuel to the combustion chamber. The fuel delivery system includes a vapor separator that contains the fuel and removes vapor from the fuel. The vapor separator is disposed between the engine body and the intake conduit. The vapor separator has a drainage mechanism to drain the fuel and an atmosphere introduction mechanism to introduce atmosphere that replaces a volume of the drained fuel. At least the atmosphere introduction mechanism includes an operating member that has an axis along which the operating member moves. The axis does not intersect with the intake conduit.

In accordance with another aspect of the present invention, an internal combustion engine for an outboard motor comprises an engine body. A moveable member is moveable relative to the engine body. The engine body and the moveable member together define at least one combustion chamber. A fuel injection system is arranged to spray fuel for combustion in the combustion chamber. The fuel injection system includes a vapor separator that contains the fuel and removes vapor from the fuel. The vapor separator has a drainage mechanism to drain the fuel and an atmosphere introduction mechanism that is manually operable to introduce atmosphere that replaces a volume of the drained fuel.

BRIEF DESCRIPTION OF THE DRAWINGS

These and other features, aspects and advantages of the present invention will now be described with reference to the drawings of a preferred embodiment, which embodiment is intended to illustrate and not to limit the present invention. The drawings comprise five figures.

DETAILED DESCRIPTION OF A PREFERRED EMBODIMENT OF THE INVENTION

Figure 1:
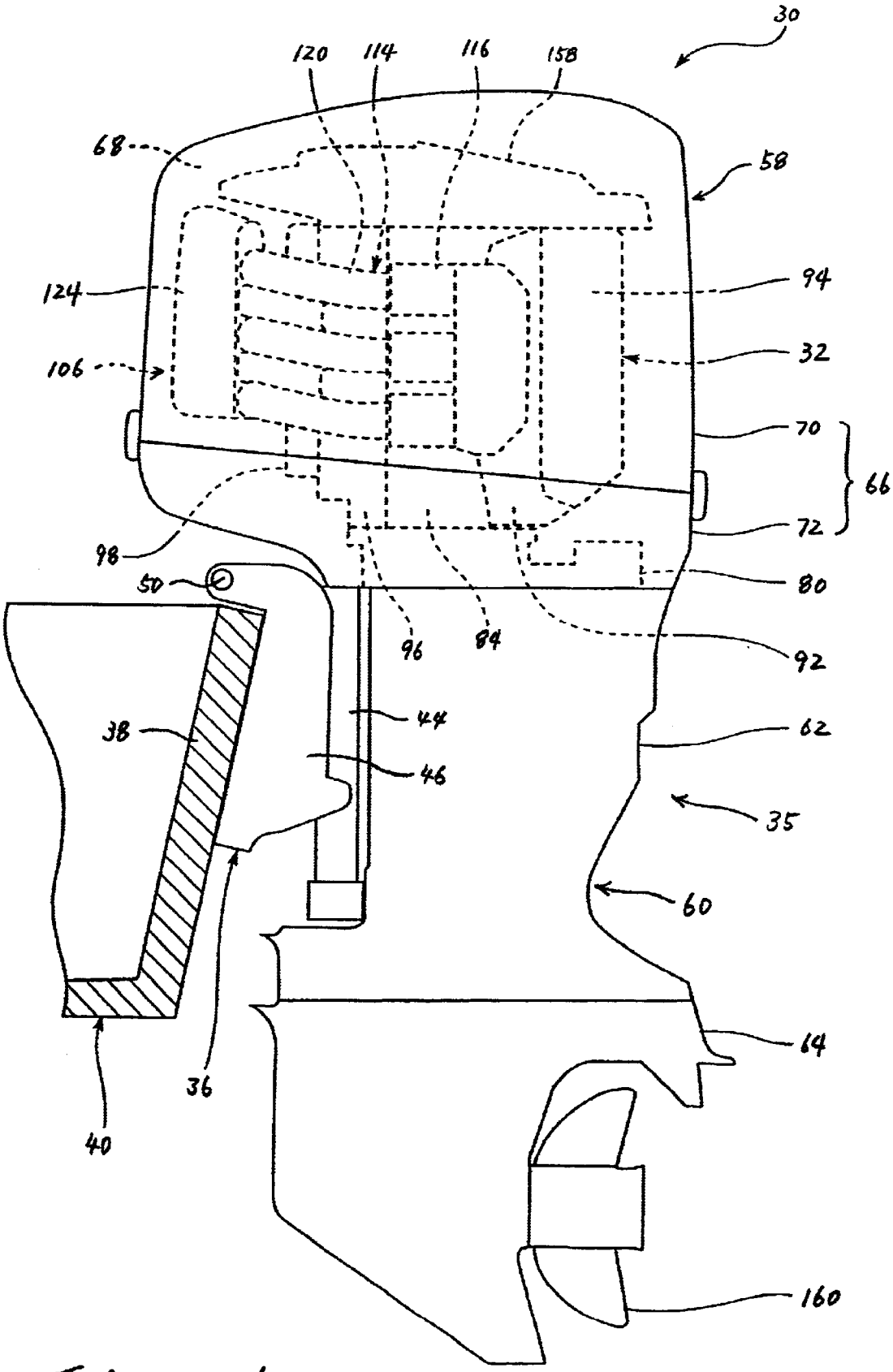
FIG. 1 is a side elevational view of an outboard motor configured in accordance with a preferred embodiment of the present invention. An associated watercraft is partially shown in section.
Figure 2:
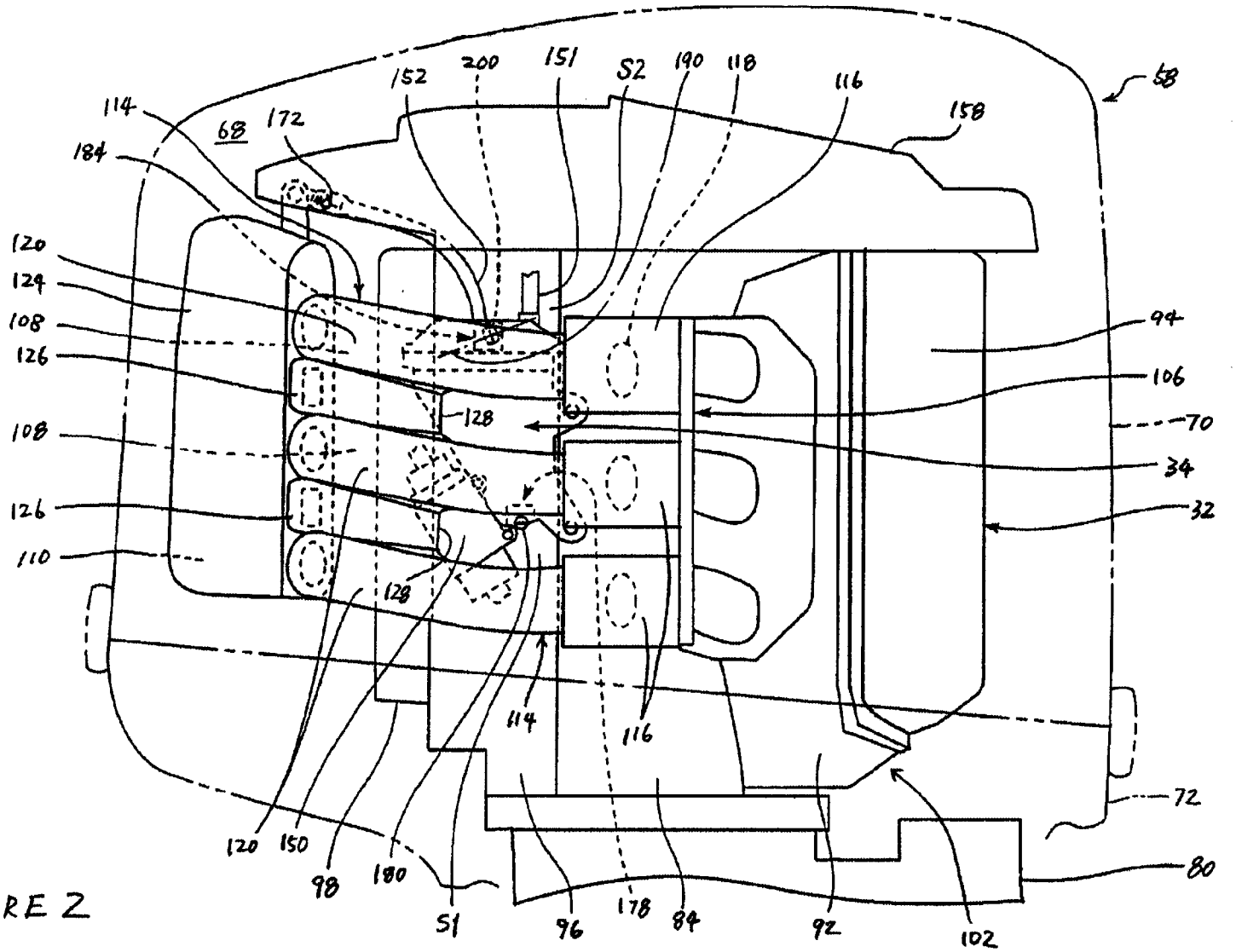
FIG. 2 is an enlarged side elevational view of an engine of the outboard motor. A protective cowling is shown in phantom line.
Figure 3:
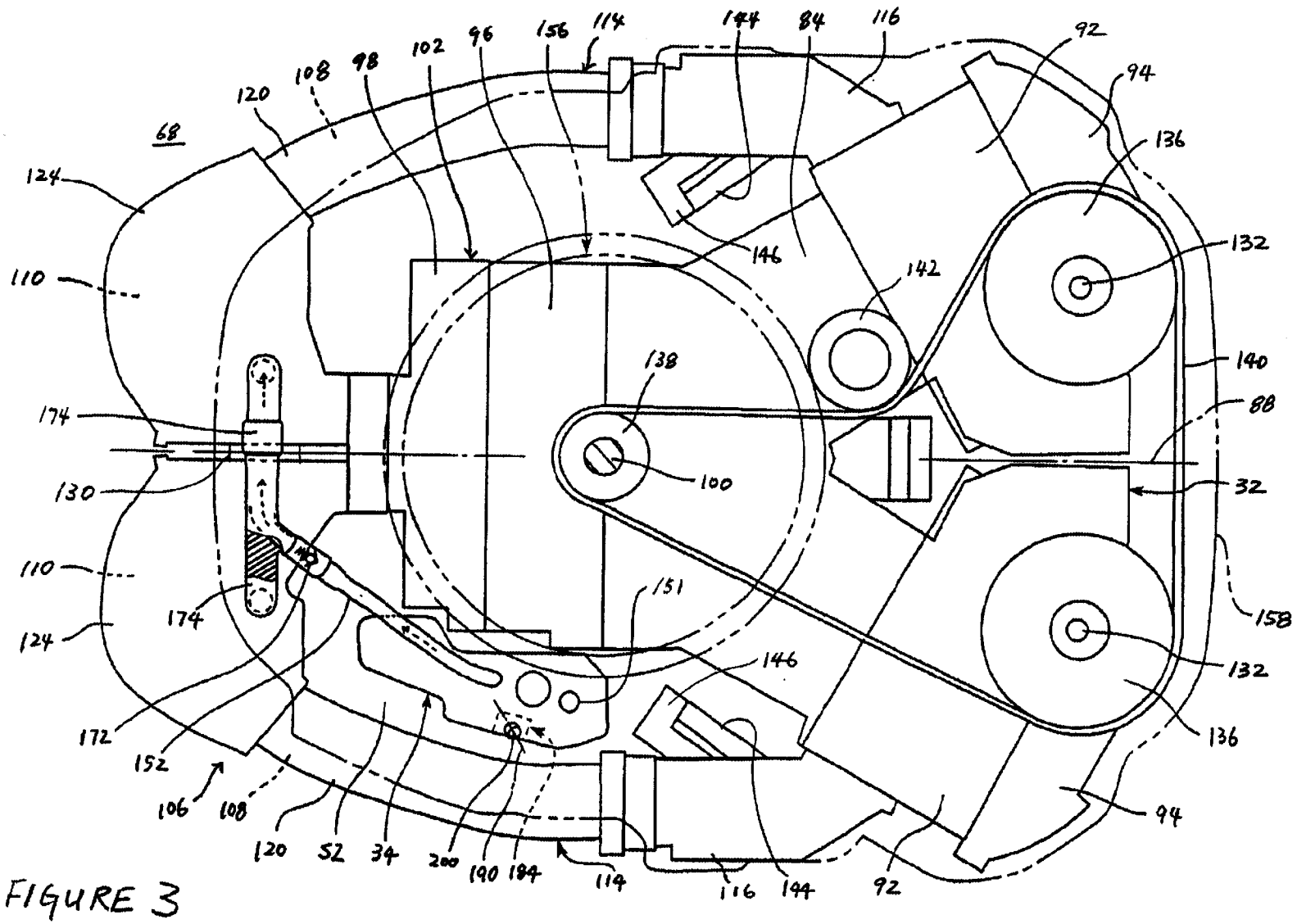
FIG. 3 is a top plan view of the engine. An engine cover and a flywheel magneto are shown in phantom line.

With reference to FIGS. 1–3, an overall construction of an outboard motor 30 that employs an internal combustion engine 32 will be described. The engine 32 preferably comprises an improved vapor separator 34 that is arranged and configured in accordance with certain features, aspects and advantages of the present invention.

In the illustrated arrangement, the outboard motor 30 generally comprises a drive unit 35 and a bracket assembly 36. The bracket assembly 36 supports the drive unit 35 on a transom 38 of an associated watercraft 40 and places a marine propulsion device in a submerged position with the watercraft 40 resting relative to a surface of a body of water. The bracket assembly 36 preferably comprises a swivel bracket 44, a clamping bracket 46, a steering shaft and a pivot pin 50.

The steering shaft typically extends through the swivel bracket 44 and is affixed to the drive unit 35. The steering shaft is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 35 thus can be tilted or trimmed about the pivot pin 50.

As used in this description, the terms "forward," "forwardly" and "front" mean at or to the side where the bracket assembly 36 is located, unless indicated otherwise or otherwise readily apparent from the context of use. The terms "rear," "reverse," "backwardly" and "rearwardly" mean at or to the opposite side of the front side.

A hydraulic tilt and trim adjustment system preferably is provided between the swivel bracket 44 and the clamping bracket 46 for tilt movement (raising or lowering) of the swivel bracket 44 and the drive unit 35 relative to the clamping bracket 46. Otherwise, the outboard motor 30 can have a manually operated system for tilting the drive unit 35.

The illustrated drive unit 35 comprises a power head 58 and a housing unit 60, which includes a driveshaft housing 62 and a lower unit 64. The power head 58 is disposed atop the housing unit 60 and includes the internal combustion engine 32 that is positioned within a protective cowling assembly 66, which preferably is made of plastic. In most arrangements, the protective cowling assembly 66 defines a generally closed cavity 68 in which the engine 32 is disposed. The engine, thus, is generally protected from environmental elements by the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism to provide access to the engine 32 for maintenance or for other purposes.

The top cowling member 70 preferably has a rear intake opening (not shown) defined through an upper rear portion. A rear intake member with one or more air ducts can be unitarily formed with or affixed to the top cowling member 70. The rear intake member, together with the upper rear portion of the top cowling member 70, generally defines a rear air intake space. Ambient air is drawn into the closed cavity 68 via the rear intake opening and the air ducts of the rear intake member. Typically, the top cowling member 70 tapers in girth toward its top surface, which is in the general proximity of the air intake opening. The taper helps to reduce the lateral dimension of the outboard motor, which helps to reduce the air drag on the watercraft 40 during movement.

The bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally define a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIGS. 2 and 3, the presently preferred engine 32 is a DOHC six cylinder engine and has a cylinder block 84 configured as a V shape. The cylinder block 84 thus defines two cylinder banks which extend side by side with each other. In the illustrated arrangement, each cylinder bank has three cylinder bores such that the cylinder block 84 has six cylinder bores in total. The cylinder bores of each bank extend generally horizontally and are generally vertically spaced from one another. This type of engine, however, merely exemplifies one type of engine. Engines having other numbers of cylinders, having other cylinder arrangements (in-line, opposing, etc.), and operating on other combustion principles (e.g., crankcase compression two-stroke or rotary) also can be used. The illustrated engine 32 generally is symmetrical about a longitudinal center plane 88 (FIG. 3) that extends generally vertically and fore to aft of the outboard motor 30.

As used in this description, the term "horizontally" means that the subject portions, members or components extend generally in parallel to the water surface (i.e., generally normal to the direction of gravity) when the associated watercraft 40 is substantially stationary with respect to the water surface and when the drive unit 35 is not tilted (i.e., is placed in the position shown in FIG. 1). The term "vertically" in turn means that portions, members or components extend generally normal to those that extend horizontally.

A moveable member, such as a reciprocating piston, moves relative to the cylinder block 84 in a suitable manner. In the illustrated arrangement, one piston (not shown) reciprocates within each cylinder bore.

Because the cylinder block 84 is split into the two cylinder banks, each cylinder bank extends outward at an angle to an independent first end in the illustrated arrangement. A pair of cylinder head members 92 are affixed to the respective first ends of the cylinder banks to close those ends of the cylinder bores. The cylinder head members 92, together with the associated pistons and cylinder bores, preferably define six combustion chambers (not shown). Of course, the number of combustion chambers can vary, as indicated above. Each of the cylinder head members 92 is covered with a cylinder head cover member 94 in the illustrated arrangement.

A crankcase member 96 is coupled with the cylinder block 84 and a crankcase cover member 98 is connected to the crankcase member 96. The crankcase member 96 and the crankcase cover member 98 close the other end of the cylinder bores and, together with the cylinder block 84, define a crankcase chamber.

A crankshaft 100 extends generally vertically through the crankcase chamber and can be journaled for rotation about a rotational axis by several bearing blocks. The rotational axis of the crankshaft 100 preferably is positioned along the longitudinal center plane 88. Connecting rods couple the crankshaft 100 with the respective pistons in any suitable manner. Thus, the reciprocal movement of the pistons rotates the crankshaft 100.

Preferably, the crankcase cover member 98 is located at the forward-most position of the engine 32, with the crankcase member 96, the cylinder block 84, the cylinder head members 92 and the cylinder head cover members 94 being disposed rearward from the crankcase cover member 98, one after another. In the illustrated arrangement, the cylinder block 84, the cylinder head members 92, the cylinder head cover members 94, the crankcase member 96 and the crankcase cover member 98 together define an engine body 102. Preferably, at least these major engine portions 84, 92, 94, 96, 98 are made of aluminum alloy. In some arrangements, the cylinder head cover members 94 can be unitarily formed with the respective cylinder head members 92. Also, the crankcase cover member 98 can be unitarily formed with the crankcase member 96.

The engine 32 also comprises an air intake system 106 (see FIG. 3). The air intake system 106 draws air from within the cavity 68 and supplies the air to the combustion chambers. The air intake system 106 preferably comprises six intake passages 108 and a pair of plenum chambers 110. In the illustrated arrangement, each cylinder bank is allotted with three intake passages 108 and one plenum chamber 110.

The most-downstream portions of the intake passages 108 preferably are defined within the cylinder head members 92 as inner intake passages. Thus, these portions can be integrally formed in the cylinder head members 92. The inner intake passages communicate with the combustion chambers through intake ports, which are formed at inner surfaces of the cylinder head members 92. Typically, each of the combustion chambers has one or more intake ports.

Intake valves can be slideably disposed at each cylinder head member 92 to move between an open position and a closed position. As such, the valves act to open and close the ports to control the flow of air into the combustion chamber. Biasing members, such as springs, are used to urge the intake valves toward the respective closed positions by acting between a mounting boss formed on each cylinder head member 92 and a corresponding retainer that is affixed to each of the valves. When each intake valve is in the open position, the inner intake passage that is associated with the intake port communicates with the associated combustion chamber.

Outer portions of the intake passages 108, which are disposed outside of the cylinder head members 92, preferably are defined with intake conduits 114. In the illustrated arrangement, each intake conduit 114 is formed with two pieces. One piece is a throttle body 116 in which a throttle valve assembly 118 (see FIG. 2) is positioned. The throttle valve assemblies 118 are schematically illustrated in FIG. 2. The throttle bodies 116 are connected to the inner intake passages.

Another piece is an intake runner 120 disposed upstream of the throttle body 116. The respective intake conduits 114 extend forwardly along side surfaces of the engine body 102 on both the port side and the starboard side from the respective cylinder head members 92 toward the front of the crankcase cover member 98. The intake conduits 114 on the same side preferably extend generally in parallel to each other and, more preferably, are vertically spaced apart from one another to define spaces S1 therebetween.

Each throttle valve assembly 118 preferably includes a throttle valve. Preferably, the throttle valves are butterfly valves that have valve shafts journaled for pivotal movement about a generally vertical axis. In some arrangements, the valve shafts are linked together and are connected to a control linkage. The control linkage would be connected to an operational member, such as a throttle lever, that is provided on the watercraft or otherwise proximate the operator of the watercraft 40. The operator can control the opening degree of the throttle valves in accordance with operator demand through the control linkage. That is, the throttle valve assemblies 118 can measure or regulate amounts of air that flow through the intake passages 108 to the combustion chambers in response to the operation of the operational member by the operator. Normally, the greater the opening degree, the higher the rate of airflow and the higher the engine speed.

The respective plenum chambers 110 preferably are defined with plenum chamber units 124 which are disposed side by side in front of the crankcase cover member 98 and are affixed thereto. Preferably, the plenum chamber units 124 are arranged substantially symmetrically relative to the longitudinal center plane 88. In the illustrated arrangement, each forward end portion of the intake runners 120 is housed within each plenum chamber unit 124.

As shown in FIG. 2, each plenum chamber unit 124 preferably has two air inlets 126, which extend generally rearwardly between the respective intake runners 120. The respective air inlets 126 define inlet openings 128 through which air is drawn into the plenum chambers 110. In one arrangement, the intake runners 120 and the air inlets 126 can be unitarily formed with the associated plenum chamber unit 124 and those three components 120, 124, 126 can be made of plastic. The respective plenum chamber units 124 preferably can be connected with each other through one or more connecting pipes 130 (see FIG. 3) to substantially equalize the internal pressures between the chamber units 124. The plenum chambers 110 coordinate or smooth air delivered to each intake passage 108 and also act as silencers to reduce intake noise.

The air within the closed cavity 68 is drawn into the plenum chambers 110 through the inlet openings 128 of the air inlets 126. The air expands within the plenum chambers 110 to reduce pulsations and then enters the outer intake passages 108. The air passes through the outer intake passages 108 and flows into the inner intake passages. The level of airflow is measured by the throttle valve assemblies 118 before the air enters the inner intake passages.

The engine 32 further comprises an exhaust system that routes burnt charges, i.e., exhaust gases, to a location outside of the outboard motor 30. In one preferred arrangement, each cylinder head member 92 defines a set of inner exhaust passages that communicate with the combustion chambers through one or more exhaust ports, which may be defined at the inner surfaces of the respective cylinder head members 92. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically within the cylinder block 84 between the cylinder bores of both the cylinder banks (i.e. in the valley of the v-shape). The exhaust manifolds communicate with the combustion chambers through the inner exhaust passages and the exhaust ports to collect exhaust gases therefrom. The exhaust manifolds are coupled with the exhaust discharge passage of the exhaust guide member 80. When the exhaust ports are opened, the combustion chambers communicate with the exhaust discharge passage through the exhaust manifolds.

A valve cam mechanism preferably is provided for actuating the intake and exhaust valves in each cylinder bank. Preferably, the valve cam mechanism includes a pair of camshafts 132 per cylinder bank, although one of them is not shown in the figures. The camshafts 132 are intake and exhaust camshafts. The illustrated camshafts 132 extend generally vertically and are joumaled for rotation between the cylinder head members 92 and the cylinder head cover members 94. The camshafts 132 have cam lobes to push valve lifters that are affixed to the respective ends of the intake and exhaust valves in any suitable manner. The cam lobes repeatedly push the valve lifters in a timed manner, which is in proportion to the engine speed. The movement of the lifters generally is timed by rotation of the camshafts 132 to appropriately actuate the intake and exhaust valves.

A camshaft drive mechanism preferably is provided for driving the valve cam mechanism. As illustrated in FIG. 3, the camshaft drive mechanism preferably comprises driven sprockets 136 positioned atop the camshafts 132, a drive sprocket 138 positioned atop the crankshaft 100 and a timing belt or chain 140 wound around the driven sprockets 136 and the drive sprocket 138. The crankshaft 100 thus drives the respective camshafts 132 through the timing belt 140 in the timed relationship. A belt tensioner 142 keeps the timing belt 140 tight on the sprockets 136, 138. The other camshaft on each bank is driven by the camshaft driven by the crankshaft 100 or the first camshaft via another belt or chain. Because the camshafts 132 must rotate at half of the rotational speed of the crankshaft 100 in a four-cycle engine, a diameter of the driven sprockets 136 is twice as large as a diameter of the drive sprocket 138.

The engine 32 further comprises indirect, port or intake passage fuel injection as a fuel delivery system. The fuel injection system preferably comprises six fuel injectors 144 with one fuel injector allotted for each one of the respective combustion chambers. The fuel injectors 144 preferably are mounted on the throttle bodies 116 of the respective banks with a pair of fuel rails 146. The fuel rails 146 connect the fuel injectors 144 on the same bank with each other and also define portions of fuel conduits to deliver fuel to the injectors 144.

Each fuel injector 144 preferably has an injection nozzle directed downstream within the associated intake passage 108, which is downstream of the throttle valve assembly 118. The fuel injectors 144 spray fuel into the intake passages 108 under control of an electronic control unit (ECU) (not shown). The ECU controls both the initiation timing and the duration of the fuel injection cycle of the fuel injectors 144 so that the nozzles spray a proper amount of fuel each combustion cycle.

Typically, a fuel supply tank disposed on a hull of the associated watercraft 40 contains fuel for the outboard motor 30. The fuel is delivered to the fuel rails 146 through the fuel conduits. The vapor separator 34 preferably is disposed along the conduits to separate vapor from the fuel and can be mounted on the engine body 102 along the port side surface. In the illustrated embodiment, the fuel injection system employs at least two fuel pumps to deliver the fuel to and from the vapor separator 34. More specifically, a lower pressure pump 150, which is affixed to the vapor separator 34, pressurizes the fuel for delivery toward the vapor separator 34, while a high pressure pump (not shown) which is disposed within the vapor separator 34 is applied to pressurize the fuel from the vapor separator 34. FIGS. 2 and 3 show a fuel delivery conduit 151 through which the fuel is pumped out to the fuel rails 146 from the vapor separator 34.

A vapor delivery conduit 152 couples the vapor separator 34 with at least one of the plenum chambers 110. The vapor thus can be delivered to the plenum chamber 110 for delivery to the combustion chambers together with the air for combustion. In other applications, the engine 32 can be provided with a ventilation system arranged to send lubricant vapor to the plenum chambers. In such applications, the fuel vapor also can be sent to the plenum chambers via the ventilation system.

The fuel injection system, particularly, the illustrated vapor separator 34 and also the vapor delivery conduit 152 will be described in greater detail below. However, similar fuel injection systems are disclosed, for example, in U.S. Pat. Nos. 5,375,578, 5,404,858, 5,797,378, 5,865,160, 5,873,347, 5,915,363 and 5,924,409, and the disclosures of which are hereby expressly incorporated by reference. It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition system. Each combustion chamber is provided with a spark plug, which preferably is disposed between the intake and exhaust valves. Each spark plug has electrodes that are positioned in the associated combustion chamber and that are spaced apart from each other by a small gap. The spark plugs are connected to the ECU through ignition coils. The spark plugs generate a spark between the electrodes to ignite an air/fuel charge in the combustion chamber at a selected ignition timing under the control of the ECU.

Generally, during an intake stroke of the engine 32, air is drawn into the combustion chambers through the air intake passages 108 and fuel is injected into the intake passages 108 by the fuel injectors 144. The air and the fuel thus are mixed to form the air/fuel charge in the combustion chambers. At a beginning of a power stroke, the respective spark plugs ignite the compressed air/fuel charge in the respective combustion chambers. The air/fuel charge thus rapidly burns during the power stroke to move the pistons. The burnt charge, i.e., exhaust gases, then are discharged from the combustion chambers during an exhaust stroke following the power stroke.

The engine 32 may comprise a cooling system, a lubrication system and other systems, mechanisms or devices other than the systems described above. Such systems can be arranged in any suitable manner.

A flywheel assembly 156, which is schematically illustrated with phantom line in FIG. 3, preferably is positioned atop the crankshaft 100 and is mounted for rotation with the crankshaft 100. The flywheel assembly 156 comprises a flywheel magneto or AC generator that supplies electric power directly or indirectly (e.g. via a battery) to various electrical components, such as the fuel injection system, the ignition system and the ECU, for instance. An engine cover 158 extends over almost all of the engine 32, including the flywheel assembly 156.

With reference again to FIG. 1, the driveshaft housing 62 depends from the power head 58 and supports a driveshaft, which is coupled with the crankshaft 100 and which extends generally vertically through the driveshaft housing 62. The driveshaft is journaled for rotation and is driven by the crankshaft 100. The driveshaft housing 62 preferably defines an internal section of the exhaust system that leads the majority of exhaust gases to the lower unit 64. The internal section includes an idle discharge portion that branches off of a main portion of the internal section such that idle exhaust gases can be discharged directly out to the atmosphere through a discharge port that is formed on a rear surface of the driveshaft housing 62.

The lower unit 64 depends from the driveshaft housing 62 and supports a propulsion shaft that is driven by the driveshaft. The propulsion shaft extends generally horizontally through the lower unit 64 and is journaled for rotation. A propulsion device is attached to the propulsion shaft. In the illustrated arrangement, the propulsion device is a propeller 160 that is affixed to an outer end of the propulsion shaft. The propulsion device, however, can take the form of a dual counter-rotating system, a hydrodynamic jet, or any of a number of other suitable propulsion devices.

A transmission preferably is provided between the driveshaft and the propulsion shaft, which lie generally normal to each other (i.e., at a 90° shaft angle) to couple together the two shafts by bevel gears. The outboard motor 30 has a clutch mechanism that allows the transmission to change the rotational direction of the propeller 160 among forward, neutral and reverse.

The lower unit 64 also defines an internal section of the exhaust system that is connected with the internal exhaust section of the driveshaft housing 62. At engine speeds above idle, the exhaust gases generally are discharged to the body of water surrounding the outboard motor 30 through a discharge section defined within the hub of the propeller 160.

Figure 4:
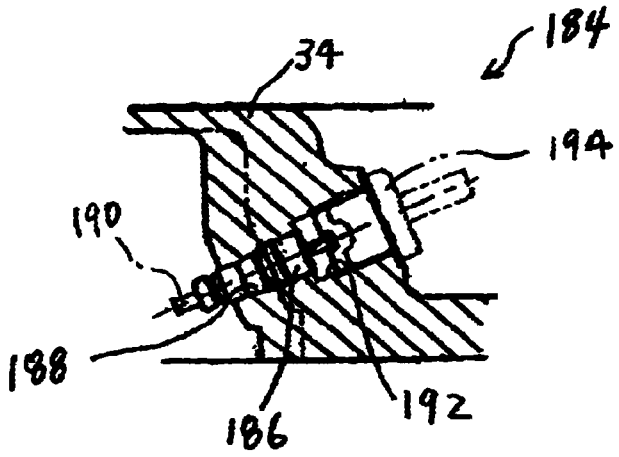
FIG. 4 is a partial top plan view of a vapor separator showing a positioning of an atmosphere introduction mechanism. A dust cap is shown in phantom line.

With reference still to FIGS. 2 and 3 and additional reference to FIGS. 4 and 5, the vapor separator 34 and the vapor delivery conduit 152 will now be described in greater detail.

The illustrated vapor delivery conduit 152 connects an upper region inside of the vapor separator 34 with the plenum chamber 110 located on the starboard side. In some arrangements, the connection could be with the port plenum chamber 110. The illustrated delivery conduit 152 has a solid portion 170 (FIG. 3) that is branched off therefrom. This solid portion 170 is coupled to the plenum chamber unit 124 on the port side to better secured the vapor delivery conduit 152.

The illustrated delivery conduit 152 also has a check valve 172 that can be in an open position when a pressure in the vapor separator 34 is greater than a preset pressure. The check valve 172 regulates the flow of vapor into the plenum chamber 110.

The illustrated vapor delivery conduit 152 also has a filter 174 to remove foreign substances from the vapor. The filter 174 also is useful to trap the vapor and then to gradually release it. This is advantageous because the delivery of the vapor is less likely to affect the air/fuel ratio.

The vapor separator 34 preferably comprises a drainage mechanism 178 to drain the fuel in the vapor separator 34 for maintenance or for storage of the outboard motor 30. The drainage mechanism 178 can comprise, for example, a drain hole and a drain plug 180 threaded into the drain hole. The drain hole preferably is formed in a lowermost portion of the vapor separator 34 when the outboard motor is in the operating position. The illustrated drain hole opens in the space S1 defined between the two lowermost intake conduits 114. The drain hole preferably has an axis that extends generally normal to the center plane 88. The drain plug 180 acts as an operating member of the drainage mechanism 178 and preferably is moveable along the axis. In the illustrated arrangement, the axis does not intersect with either the lowermost positioned intake conduit 114 or the intake conduit 114 positioned next to the lowermost positioned conduit 114. The illustrated drain plug 180, thus, is easily operable at a location positioned between those conduits 114.

The illustrator vapor separator 34 further comprises an atmosphere introduction mechanism 184 to introduce air that replaces a displaced volume of the fuel in the vapor separator 34 such as during draining. FIG. 4 illustrates an exemplary construction of the atmosphere introduction mechanism 184. The introduction mechanism 184 preferably comprises a valve 186 and an opening 188 in which the valve 186 is fitted.

In one arrangement, the opening 188 is formed atop of the vapor separator 34 and communicates with a space S2 defined among the uppermost intake conduit 114, the engine cover 158 and the inner upper space of the vapor separator 34. The opening 188 has an axis 190 as shown in FIGS. 2–4. In the illustrated embodiment, the opening 188 has two different diameters such that a first portion which communicates with the inner upper space of the vapor separator 34 has a smaller diameter than a second portion which communicates with the space S2. The first portion substantially supports the valve 186. The second portion defines a recess 192 into which a dust-proof cap 194 can be fitted. The illustrated cap 194 can be removably placed in the recess 192. The valve 186 is manually operable with a tool by detaching the cap 194.

Figure 5:
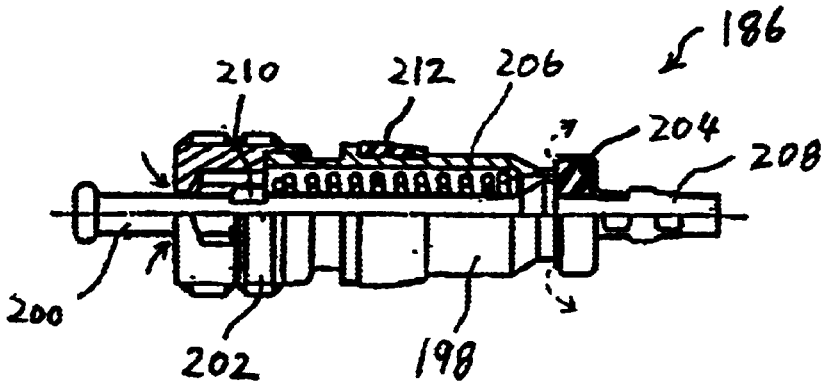
FIG. 5 is an enlarged view of a manually operated valve of the atmosphere introduction mechanism.

FIG. 5 illustrates an exemplary construction of the valve 186. The valve 186 generally comprises a valve body 198, a shaft 200, a head member 202, a valve seat 204 and a coil spring 206. The head member 202 is connected to one end of the body 198. The valve body 198, together with the head member 202, supports the shaft 200. Both the valve body 198 and the head member 202 comprise a lumen through which the shaft 200 extends. The lumen narrows in the head member 202 but the lumen still defines a small gap between the shaft 200 and the head member 202.

The shaft 200 defines an operating member of the atmosphere introduction mechanism 184 and the shaft 200 is axially moveable within the lumen. Preferably, the valve seat 204 is rigidly mounted to the shaft 200. The valve seat 204 is made of, for example, a rubber material and can be connected to the shaft 200 by a support member 208.

The spring 206 is confined within the hollow of the valve body 198 and extends around the shaft 200. An inner shoulder portion is formed in the valve body 198. The shoulder portion supports one end of the spring 206 while spring retainer 210, also formed on the shaft 200, supports the other end of the spring 206. Thus, the spring 206 urges the shaft 200 in a direction away from the valve seat 204 such that the valve seat 204 abuts on a portion of the valve body 198. This is a closed position. When the shaft 200 moves within the valve body 198 in a direction toward the valve seat 204, the valve seat 204 separates from the end of the valve body 198 and a gap is formed therebetween. This is an open position.

In the illustrated arrangement, the valve 186 is positioned in the opening 188 such that an axis of the shaft 200 is consistent with the axis 190. At least the valve seat 204 and the end of the valve body 198 preferably are placed within the inner upper space of the vapor separator 34. As such, a tip portion of the shaft 200 is disposed within the recess 192. A seal 212 surrounds the valve body 198 to sealingly secure the valve 186 in the opening 188. The axis 190 along which the shaft 200 moves is arranged not to intersect with the uppermost intake conduit 114. Thus, manipulation of the shaft 200 is not prevented by its placement. In other words, the shaft 200 is operable at a location positioned generally above the uppermost intake conduit 114.

For maintenance of the engine 32 or for storage of the outboard motor 30, the dust-proof cap 194 first is detached from the recess 192 to expose the tip portion of the shaft 200. Also, the drain plug 180 is removed from the drain hole. The valve 186 is held in the closed position by the bias force of the spring 206 and the air is not introduced into the vapor separator 34. When the tip portion of the shaft 200 is pushed, such as, with a tool, for instance, the valve 186 is opened against the bias force of the spring 206. The ambient air is introduced into the vapor separator 34 to replace the volume of the fuel which is being drained. Thus, fuel can be drained quickly and efficiently. In addition, the drain plug 180 and the shaft 200 of the valve 186 have axes that do not intersect with any one of the intake conduits 114 in the illustrated arrangement. Those members 180, 200, thus, are easily accessible or operable even if the vapor separator 34 is positioned behind the intake conduits 114. Furthermore, because the shaft 200 of the valve 186 is always urged toward the closed position, only one way actuation of the shaft 200 toward the open position is necessary. This can be done one-handed.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, the recess and the dust-proof cap are not necessarily provided. In one alternative, the tip portion of the shaft of the valve can expose at a surface of the vapor separator and can be operable without any tool. Accordingly, the scope of the present invention should not be limited to the illustrated configurations, but should only be limited to a fair construction of the claims that follow and any equivalents of the claims.

What is claimed is:

1. An internal combustion engine for an outboard motor comprising an engine body, a moveable member moveable relative to the engine body, the engine body and the moveable member together defining at least one combustion chamber, an air intake system communicating to the combustion chamber, the intake system including an intake conduit extending along at least part of the engine body, and a fuel delivery system arranged to deliver fuel to the combustion chamber, the fuel delivery system including a vapor separator that contains a volume of fuel, the vapor separator being disposed between the engine body and the intake conduit, the vapor separator having a drainage mechanism and an atmosphere introduction mechanism, the atmosphere introduction mechanism comprising an operating member, the operating member being adapted to move along an axis that does not intersect with the intake conduit.

2. The engine as set forth in claim 1, wherein the atmosphere introduction mechanism comprises a valve, the valve being connected to the operating member such that the operating member shifts the valve between an open position in which purge air is introduced into the vapor separator and a closed position in which purge air is not introduced into the vapor separator.

3. The engine as set forth in claim 2, wherein the atmosphere introduction mechanism comprises a biasing member, the biasing member being connected to the operating member that urges the operating member to hold the valve in the closed position.

4. The engine as set forth in claim 1, wherein the intake conduit extends generally horizontally, and the operating member is operable at a location positioned generally vertically higher than the intake conduit.

5. The engine as set forth in claim 1, wherein the drainage mechanism comprises a second operating member that has a second axis along which the second operating member moves, and the second axis does not intersect with the intake conduit.

6. The engine as set forth in claim 5, wherein the second operating member is operable at a location positioned generally vertically lower than the intake conduit.

7. The engine as set forth in claim 5, wherein the air intake system includes a plurality of intake conduits that extend generally horizontally, the first operating member being operable at a location positioned generally vertically higher than at least one of the intake conduits.

8. The engine as set forth in claim 7, wherein the first operating member is operable at a location generally vertically higher than an uppermost intake conduit.

9. The engine as set forth in claim 5, wherein the air intake system includes a plurality of the intake conduits that extend generally horizontally, and the second operating member is operable at a location positioned generally vertically lower than at least one of the intake conduits.

10. The engine as set forth in claim 9, wherein the second operating member is operable at a location positioned between two of the plurality of intake conduits.

11. The engine as set forth in claim 1 additionally comprising a vapor delivery conduit arranged to couple the vapor separator with the air intake system, and the vapor delivery conduit comprising a check valve that is capable of opening when a pressure in the vapor separator is greater than a preset pressure.

12. The engine as set forth in claim 11, wherein the vapor delivery conduit additionally comprises a filter.

13. The engine as set forth in claim 1 additionally comprising a vapor delivery conduit that couples the vapor separator with the air intake system, the vapor delivery conduit comprising a filter.

14. The engine as set forth in claim 1, wherein the fuel delivery system comprises a fuel injector arranged to spray fuel for combustion in the combustion chamber.

15. An internal combustion engine for an outboard motor comprising an engine body, a member moveable relative to the engine body, the engine body and the member together defining at least one combustion chamber, a fuel injection system arranged to spray fuel for combustion in the combustion chamber, the fuel injection system including a vapor separator that contains a volume of fuel, the vapor separator having a drainage mechanism, and an atmosphere introduction mechanism, the atmosphere introduction mechanism being manually operable to introduce purge air to replace fuel.

16. The engine as set forth in claim 15, wherein the atmosphere introduction mechanism comprises a valve and an operating member that is connected to the valve, the valve being arranged to shift the valve between an open position, in which purge air is introduced into the vapor separator, and a closed position.

17. The engine as set forth in claim 16 additionally comprising an air intake system that communicates with the combustion chamber, the intake system comprising an intake conduit extending generally horizontally along at least part of the engine body, the vapor separator being disposed between the engine body and the intake conduit and the operating member being operable at a location positioned generally above the intake conduit.

18. The engine as set forth in claim 17, wherein the operating member has an axis along which the operating member moves, and the axis does not intersect with the intake conduit.

* * * * *